United States Patent [19]

Laroche

[11] Patent Number: 4,461,133

[45] Date of Patent: Jul. 24, 1984

[54] STRUCTURAL MEMBERS MODULES

[76] Inventor: Francois X. Laroche, Rte. du Mont Shefford, P.O. Box 1024, Waterloo, Quebec, Canada, J0E 2N0

[21] Appl. No.: 343,844

[22] Filed: Jan. 29, 1982

[30] Foreign Application Priority Data

Oct. 7, 1981 [CA] Canada ..... 387506

[51] Int. Cl.[3] ..... E04C 2/40

[52] U.S. Cl. ..... 52/730; 49/DIG. 1

[58] Field of Search ..... 52/93, 242, 72, 729–732; 49/DIG. 1, DIG. 2

[56] References Cited

U.S. PATENT DOCUMENTS

| | | | |
|---|---|---|---|
| 1,911,413 | 5/1933 | Wait | 52/729 |
| 3,177,989 | 4/1965 | Chiaro | 49/425 |
| 3,303,626 | 2/1967 | Brigham | 52/475 |
| 4,133,153 | 1/1979 | Hage | 52/242 |
| 4,272,941 | 6/1981 | Hasselbacher et al. | 49/DIG. 1 |

FOREIGN PATENT DOCUMENTS

| | | | |
|---|---|---|---|
| 202340 | 7/1956 | Australia | 52/461 |
| 790267 | 7/1963 | Canada . | |
| 716246 | 8/1965 | Canada . | |
| 847014 | 7/1970 | Canada . | |
| 861165 | 1/1971 | Canada . | |
| 1045327 | 1/1979 | Canada . | |
| 2028690 | 12/1970 | Fed. Rep. of Germany | 52/731 |
| 2909425 | 9/1980 | Fed. Rep. of Germany | 52/730 |

*Primary Examiner*—James L. Ridgill, Jr.

*Attorney, Agent, or Firm*—Schwartz, Jeffery, Schwaab, Mack, Blumenthal & Koch

[57] ABSTRACT

A structural building unit comprising a bar-shaped member having a central section and two edge sections with first connecting means projecting from the central section and second connecting means in each edge section. With a connecting member and/or connecting plates, one or more of the bar-shaped members are used to construct various structural modules.

15 Claims, 20 Drawing Figures

FIG. 1
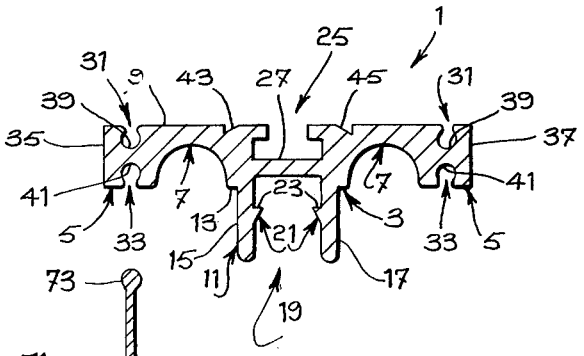
FIG. 3
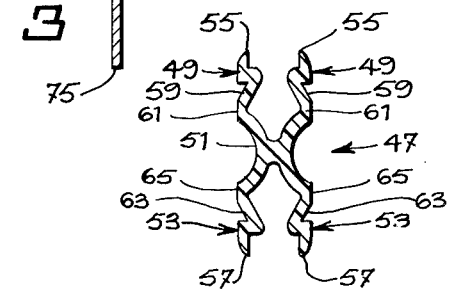
FIG. 2
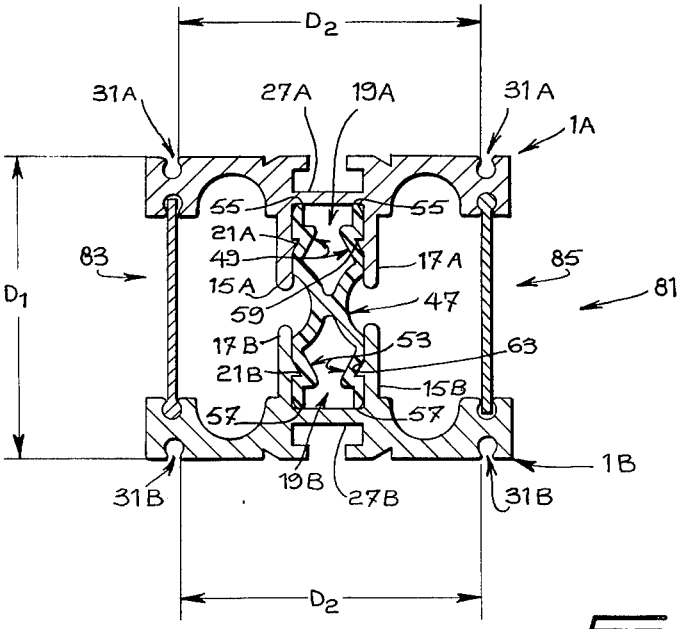
FIG. 4

STRUCTURAL MEMBERS MODULES

BACKGROUND OF THE INVENTION

This invention is directed toward a structural building unit, and toward structural building modules constructed by using one or more of the building units.

The invention is also particularly directed toward a building construction employing the building units and the building modules.

The invention is further directed toward a novel structural unit for connecting panel members together at adjacent edges.

The present invention is particularly directed toward building units for use in open-framework type buildings. One type of open-framework building is a greenhouse. The greenhouse has spaced-apart frame members providing a simple skeleton structure which supports glass or plastic panels closing the structure.

It would be desirable to provide prefabricated structural units to build an open-framework structure such as a greenhouse. Prefabricated units usually reduce on-site construction costs and their use can result in substantial savings. However the number of types of prefabricated units needed in a building structure usually has a bearing on the final cost as well. The more types of units needed, the greater the cost. Even a very simple open-framework building requires numerous different units when considering the various structural building elements needed such as plates, sills, corner posts, intermediate posts, beams, rafters and the like. In view of the number of different structural elements usually required, and the attendant cost, prefabricated, open-framework buildings are not common.

SUMMARY OF THE INVENTION

It is the purpose of the present invention to provide a minimum number of structural units which can be combined and/or modified in various ways to produce the necessary structural elements needed to construct an open-framework building. With a minimum number of units, the initial cost is minimized, while still obtaining the advantages of prefabrication.

It is another purpose of the present invention to provide a simple structural unit which can be used as a building block in building various structural modules.

It is a further purpose of the present invention to provide improved prefabricated building construction.

In designing the structural units, and more particularly the greenhouse type of building incorporating the structural units, it was found that the known connecting elements for use in joining adjacent panels together at adjacent edges, were unsatisfactory primarily because of their high cost. It is therefore another purpose of the present invention to provide improved means for use in connecting panels together which means are relatively cheaper than known connecting means.

In accordance with the present invention there is provided a generally bar-shaped, structural member having a central section and edge sections. By a bar-shaped member it is meant a member having a generally rectangular cross-sectional shape and with a long length relative to the width and thickness of the member. In addition the width of the member is usually substantially greater than the thickness. The member preferably is extruded from a light-weight metal. The member has first connecting means projecting from one wide side of the member in the central section. Second connecting means are provided in each edge section.

Two of the structural members can be joined together with a special connector to provide a structural module. The connector connects the members via the first connecting means in spaced-apart, parallel relation. The module has a generally I-shaped cross-section providing a strong beam structure suitable for carrying loads. The open ends of the module are well suited for use in mounting enclosing panels, such as glass panels, between the modules when the modules are used as rafters, studs or posts.

The modules can be slightly modified by removing selected portions of the members by cutting. The modified modules can then be combined to produce other structural units. Alternatively, a module can be combined with an additional structural member to provide other types of structural units. For example, one of the structural members can be used as a top or bottom sill plate, with or without minor modifications, to which the modules forming studs or posts are attached.

Along with the basic bar-shaped structural member, and the connector for joining two such members together to provide a structural module, there is also provided a plate element for use in connecting one module to another module, or to another structural member. The plate elements can also be combined with the basic bar-shaped member to form yet another type of structural module. The plate elements are designed to cooperate with the second connecting means in the structural member to join them to the member, or to a module. Fastening means are then used to connect the plate elements to other members or modules.

With the three basic structural units of a bar-shaped structural member, a connector, and a plate element; all of the various structural elements needed in building construction can be simply formed.

The connector is preferably made from a plastic material and thus provides a thermal barrier between the two structural members joined into an I-beam module. Alternatively, the basic structural member can itself be easily modified to provide a thermal barrier in the member.

In another aspect of the invention there is provided a connecting element having a T-shaped cross-section. The stem of the T-shaped element comprises two parallel legs spaced apart a distance equal to the width of a leg. Two such elements are joined together to provide a connecting structure having an H-shaped cross-section by slidably interlocking the legs together.

The invention is particularly directed toward a structural building unit comprising a generally bar-shaped structural member having a central section and two edge sections. First connecting means project transversally from one wide side of the member and second connecting means are provided in each edge section.

The invention is also directed toward a structural building module comprising two bar-shaped structural members with each member having a central section and two edge sections. First connecting means project transversally from one wide side of the member and second connecting means are provided in each edge section. A connecting element joins the two members together with their one wide sides facing and parallel to each other. The connecting element extends between the first connecting means of the two members.

The invention is further directed toward a structural building module having a bar-shaped structural member with a central section and two edge sections. Connecting means are provided in each edge section. At least one plate element projects from either wide side of the member, the plate element connected to the one member with the connecting means.

The invention is additional directed toward a structural connector comprised of two identical connector elements. Each element has a T-shaped cross section with the stem of the T-shaped element consisting of two parallel legs spaced apart a width equal to the width of one leg. The two elements are joined together by slidably interlocking the legs of the elements.

BRIEF DESCRIPTION OF THE DRAWINGS

The invention will now be described in detail having reference to the accompanying drawings in which:

FIG. 1 is a cross-section view of a first basic structural unit;

FIG. 2 is a cross-section view of a second basic structural unit;

FIG. 3 is a cross-section view of a third basic structural unit;

FIG. 4 is a cross-section view of a first structural module constructed from some of the units;

DETAILED DESCRIPTION OF THE PREFERRED EMBODIMENT

Figure 5:
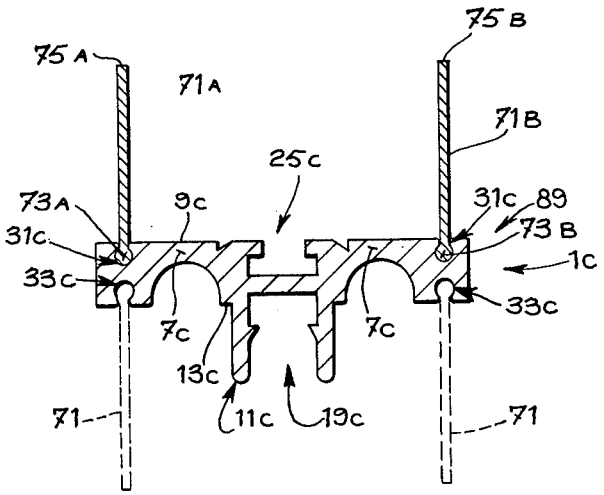
FIG. 5 is a cross-section view of a second structural module constructed from some of the unit.

In accordance with the present invention the basic structural unit comprises an extruded, metal, generally bar-shaped, structural member 1. As shown in FIG. 1, this structural member 1 has a central section 3 and a pair of edge sections 5 joined to the central section 3 by web-like sections 7. The central and edge sections 3, 5 and the web sections 7 are generally aligned on one wide side 9 of the member.

First connecting means 11 on the member 1 extend transversally from the center of the opposite wide side 13 of the member. These connecting means 11 comprise a pair of spaced-apart, parallel arms 15, 17 projecting from the central section 3 of the member. The arms 15, 17 define a generally rectangular slot 19 between them. The slot 19 can extend part way into the central section 3. A locking tab 21 projects into the slot 19 from each arm 15, 17. The tab 21 can have a triangular shape with its base 23 facing the central section 3.

The central section 3 can also have a T-shaped slot 25 therein, extending inwardly from the one side 9 of the member 1. The slot 25 is centrally located in central section 3 and is separated from the rectangular slot 19 by a narrow web 27.

Each edge section 3, 5 has second connecting means therein. The second connecting means comprise a pair of opposed grooves 31, 33. Groove 31 extends inwardly from side 9 of member 1 toward groove 33, and groove 33 extends inwardly from side 13 of member 1 toward groove 31. The grooves 31, 33 in each edge section 3, 5 are aligned and are close to the narrow sides 35, 37 of the member 1. The bottoms 39, 41 of grooves 31, 33 respectively are circular and enlarged. A pair of shallow guide grooves 43, 45 can be provided on the one side 9 of member 1. The guide grooves 43, 45 are generally located where the central section 3 joins the web sections 7, and are used as a saw guide when removing sections from the member by cutting.

The above described structural member 1 can be used many ways in the construction of building modules such as beams and posts, and in other ways in building construction as will be described.

A second basic structural unit comprises a connector 47. The connector 47 is shown in FIG. 2 and comprises an extruded, slightly resilient member having an H-shaped cross-section. The connector has a first pair of generally parallel legs 49 extending from a central web section 51 and a second pair of generally parallel legs 53 extending from the web section 51 in an opposite direction to legs 49. Legs 49 each terminate in a free end 55 and legs 53 each terminate in a free end 57. Legs 49 have notches 59 in their outer sides 61 and legs 53 similarly have notches 63 in their outer sides 65. The connectors 47 are used to connect two structural members 1 together to form a building module as will be described.

The third basic structural unit comprises a relatively narrow, connecting plate 71 as shown in FIG. 3. This plate 71 comprises an extruded, rigid, metal member having a bead 73 on one edge, opposite its other parallel edge 75. The plate member 71 is used to connect various structural modules and building components together as will be described.

One way to employ the structural member 1 is to use it with a second identical structural member 1 to form a structural building module 81. The module 81 is formed by joining two structural members, designated by reference characters 1A, 1B, together with a connector 47, as shown in FIG. 4, to provide an I-beam type structure. As shown in FIG. 4, the first pair of legs 49 of connector 47 are inserted into slot 19A of one of the members 1A until their free ends 55 abut web 27A and tabs 21A on arms 15A, 17A defining slot 19A simultaneously enter grooves 59. The other pair of legs 53 of connector 47 are similarly inserted into the slot 19B of the other member 1B until their free ends 57 abut web 27B and tabs 21B enter grooves 63 on legs 53. With the two members 1A, 1B joined by connector 47, an I-beam type structural module 81 is provided. It will be seen that the connector 47 serves to locate the two identical members 1A, 1B an exact distance apart by contact of the ends 55, 57 of the legs 49, 53 abutting on the webs 27A, 27B and the tabs 21A, 21B simultaneously locking into the grooves 59, 63. The open ends 83, 85 of the module 81 can be used to mount closure panels between the edge sections of the two members 1A, 1B as will be described.

The I-beam module 81 is dimensioned to have its depth "D1", as shown in FIG. 4, equal to the distance "D2" between the inner edges of grooves 31A, 31B in members 1A, 1B. This permits one module 81 to be used transversally with another module 81, or transversally with another structural member 1 as will be described.

The connector 47 can preferably be made from an heat insulation material, such as a thermo-plastic material to provide a thermal barrier or break between the two identical members 1A, 1B in module 81. Also, the central web 27A, 27B in either member 1A, 1B can be easily cut if a thermal barrier or break is to be provided between the narrow sides 35A, 37A of member 1A or between the sides 35B, 37B of member 1B.

A second type of structural module 89 can be provided using the structural member 1, and at least one, and preferably two connecting plate members 71 as shown in FIG. 5. This structural module 89 usually uses the structural member 1 as a plate or sill member and uses at least one connecting plate 71 to connect the member 1 to a wall, floor, or other structural units, such as module 81 for example. The structural module 89 preferably comprises a single structural member 1C with a pair of connecting plates 71A, 71B extending transversally from either wide side 9C or 13C of the member 1. If extending from flat wide side 9C, the beads 73A, 73B of the two plates 71A, 71B are mounted within grooves 31C as shown in FIG. 5. If extending from the other wide side 13C, the beads of the two connecting plates are mounted within grooves 33C. While the two plates 71A, 71B normally extend transversally from the wide sides 9C or 13C or member 1C, they can also extend at an angle to the wide sides 9C or 13C while still parallel to each other.

Figure 6:
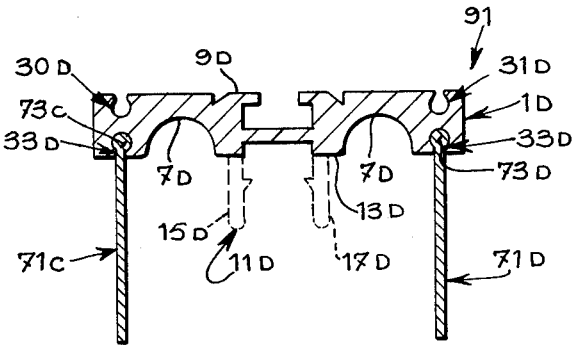
FIG. 6 is a cross-section view of a third structural module constructed from some of the units.

A third type of structural module 91 is shown in FIG. 6 and includes a structural member 1D having its connecting means 11D, shown in dotted lines, removed from side 13D. The arms 15D, 17D forming the connecting means are cut-off flush against side 13D, so as to produce two wide, relatively flat, sides 9D, 13D on member 1D. The module 91 also includes at least one, and preferably two, connecting plates 71C, 71D. The plates 71C, 71D can extend from either wide side 9D, 13D of member 1D. As shown in FIG. 6, the plates 71C, 71D extend from wide side 13D of member 1D with their beads 73C, 73D mounted within grooves 33D. The module 91 is used where a flat or sill member is needed having two wide relatively flat sides for use in mounting other members or modules to the module.

In all three basic modules 81, 89 and 91, the connecting plates 71 are easily and securely attached to the structural member 1 via their beaded edge 73 which fits snugly within the enlarged portion of slots 31, 33. The connecting plates 71, forming an integral part of the modules 81, 89 and 91 are used to connect the modules to other modules or other building units or components. Fasteners can be employed through the plates 71 to make the connection. Fasteners can also be employed through the thin web sections 7 of members 1 when used alone, or in modules 81, 89 and 91 to make suitable connections.

Figure 7:
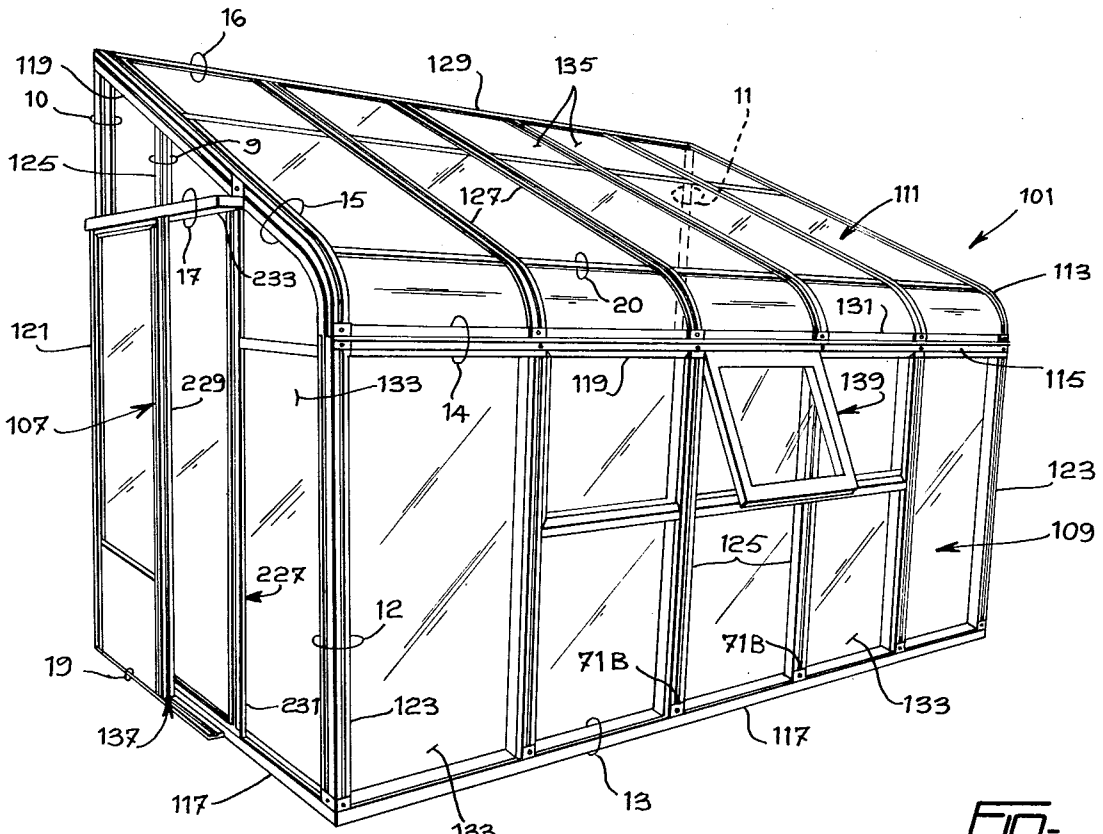
FIG. 7 is a perspective view of a greenhouse constructed with the structural units and modules.
Figure 8:
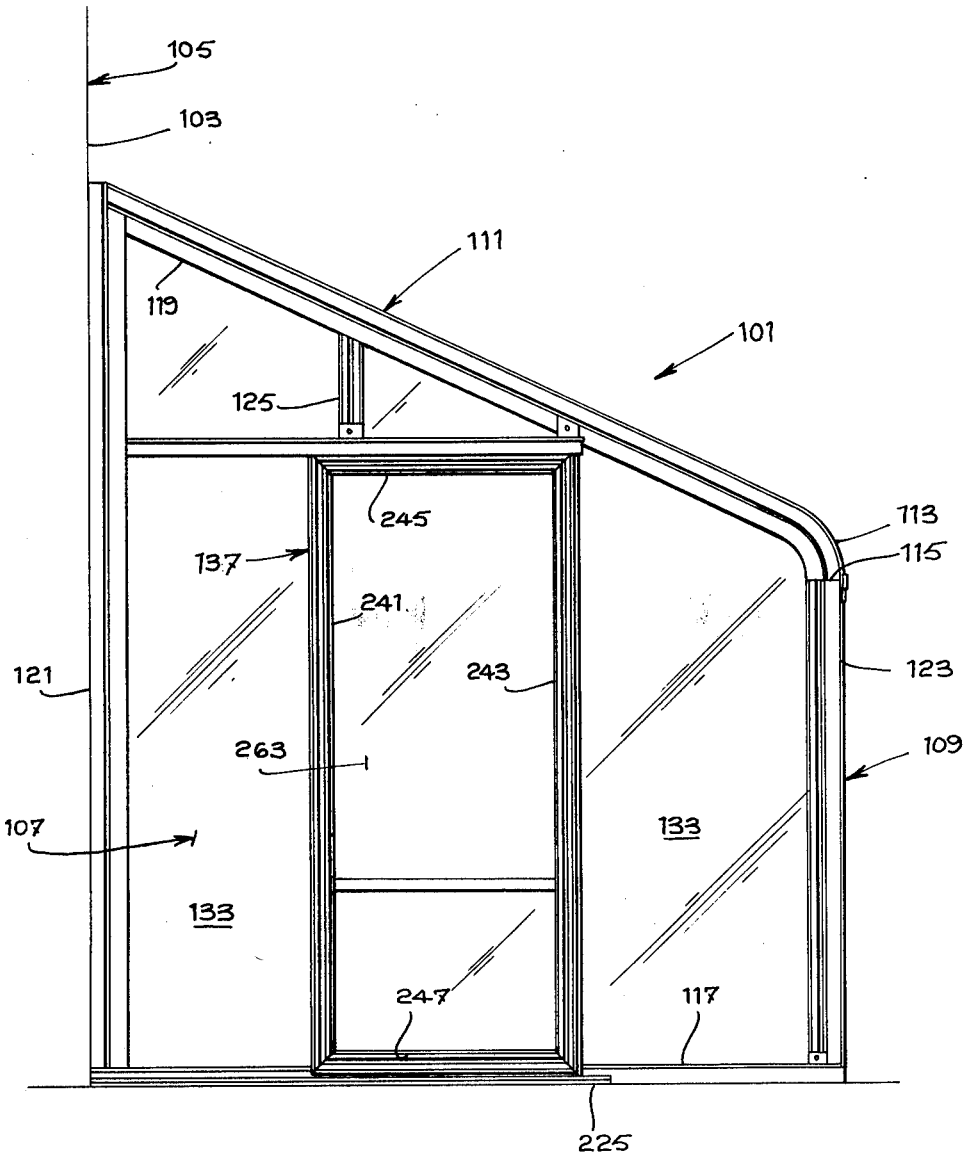
FIG. 8 is an end elevation view of the greenhouse.

The use of the structural members 1, connectors 47 connecting plates 71, and the modules 81, 89 and 91 in building construction, will now be described having reference to a greenhouse 101 as shown in FIGS. 7 and 8. The greenhouse 101 is of the shed type attached or built against the side wall 103 of an house 105 or similar building. The greenhouse 101 has end walls 107, a front wall 109 and a roof 111. The roof 111 slopes down toward the front wall 109 and can curve down at its outer portion 113 to join the top edge 115 of the front wall 109. The end and front walls 107, 109 have bottom and top sills 117, 119 and vertical corner posts or beams 121, 123 extending between the sills 117, 119 at the corners. Posts 121 join one side of the end walls 107 to the building 105. Posts 123 join the other side of end walls 107 to the sides of the front wall 109. Vertical intermediate posts 125 are provided in the end and front walls, spaced-apart between the corner posts. The roof 111 has spaced-apart rafters or ribs 127 joined at their ends by plates 129, 131. The end and front walls 107, 109 have glass panels 133 between the sills 117, 119 and the posts 121, 123 and 125. The roof 111 also has glass panels 135 between its plates 129, 131 and ribs 127. At least one door 137 may be provided in one end wall 107 and at least one window 139 may be provided mainly in the front wall 109.

The structural elements defining the greenhouse 101, such as the sills, the posts, the plates and the ribs are all constructed using the structural member 1, connectors 47, and plates 71 as the basic building blocks.

Figures 9, 10, 12:
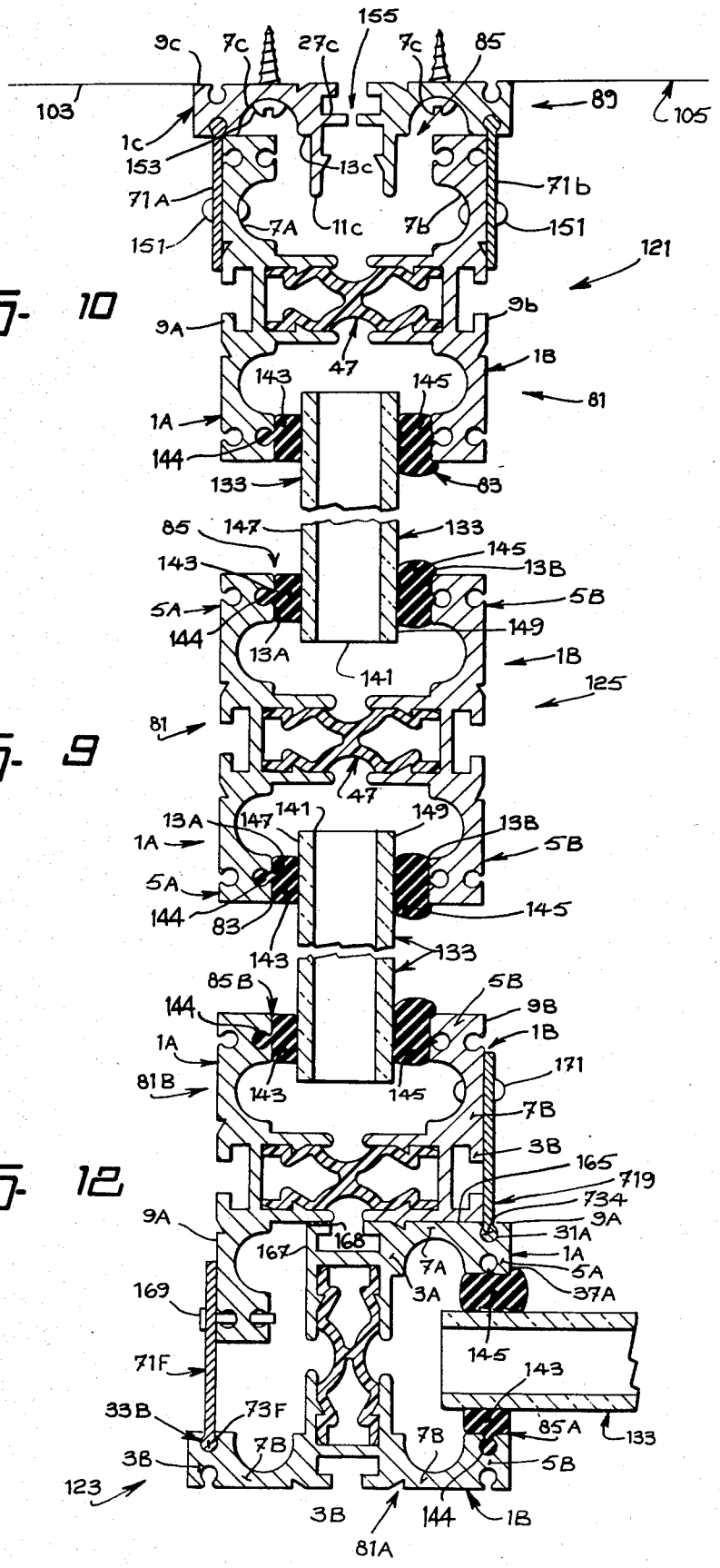
FIG. 9 is a cross-section view taken at location 9 in FIG. 7.
FIG. 10 is a cross-section view taken at location 10 in FIG. 7.
FIG. 12 is a cross-section view taken at location 12 in FIG. 7.

As shown in FIG. 9 the intermediate posts 125 can comprise the basic I-beam module 81 shown in FIG. 4 employing two structural members 1A, 1B and a connector 47. One member 1A of module 81 faces outwardly and the other member 1B faces inwardly with connector 47 acting as a thermal barrier between the members 1A, 1B. The wall glass panels 133, which can comprise thermopanel or double-glazed units, are mounted by their edges 141 in the open ends 83, 85 of the modules 81 by sealing strips 143, 145. One sealing strip 143 made with soft rubber bears between one surface 147 of glass panels 135 and the surface 13A on the edge sections 5A of member 1A. This sealing strip is stuck on surface 147 by a solid rubber wire 144, which penetrates into groove 33 before assembling the double glazed unit. The other sealing strip 145 bears between the other surface 149 of the glass panels 135 and the surface 13B of the edge sections 5B of members 1B.

The corner post 121 is shown in cross-section in FIG. 10. Each corner post 121 comprises a first basic module 81 and a second basic module 89. The second basic module 89 has the connector plates 71A, 71B projecting from the connector side 13C of its member 1C. One end 85 of first module 81 is abutted against the side 13C of member 1C in the second module 89. The connector plates 71A, 71B on the second module 89 lie flush on the flat outer sides 9A, 9B of the two members 1A, 1B forming first module 81 and are fastened to the members 1A, 1B in fasteners 151. The fasteners 151 pass through the web sections 7A, 7B in members 1A, 1B in module 81. The second module 89 is fastened to the wall 103 of the building 105 by fasteners 153 before it is connected to module 81. The fasteners 153 pass through the web sections 7C of member 1C in module 89. The member 1C in module 89 has its flat side 9C flush against the wall 103, while its connecting means 11C project into the open end 85 of the first module 81. The member 1C in second module 89 can have its central web 27C cut as shown at 155 to provide a thermal break in member 1C. The side edge of a glass panel 133 can be mounted in the other end 83 of first module 81, fastened thereto by sealing strips 143, 145.

Figure 11:
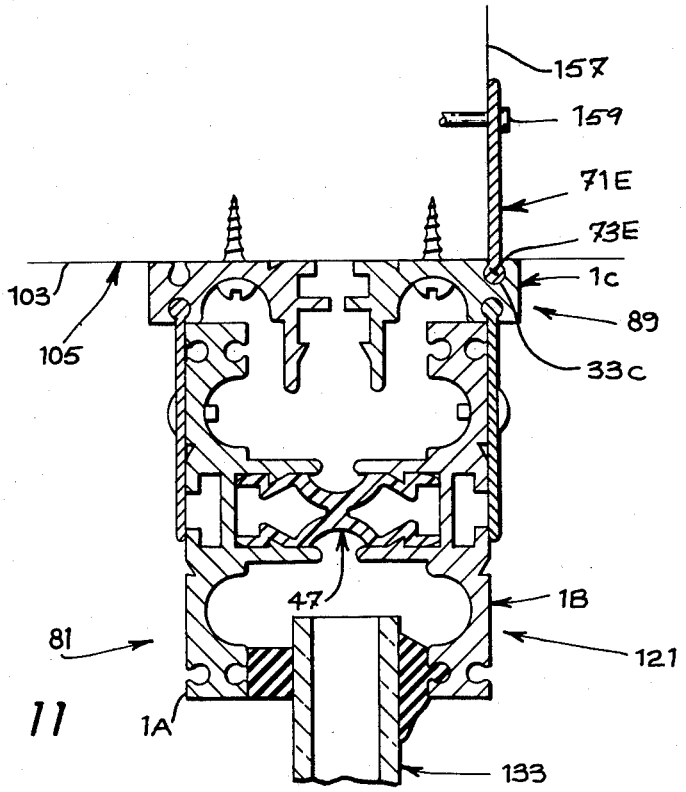
FIG. 11 is a cross-section view taken at location 11 in FIG. 7.

If one of the corner posts 121 is positioned at the end of wall 103, as shown in FIG. 11, to have one of the end walls 107 of the greenhouse aligned with the end wall 157 of the building 105, an additional closure plate 71E can be used to help fasten the post 121 to the building. The bead 73E of this additional plate 71E is inserted into groove 31C of the member 1C in second module 89 and the plate 71E extends flush against end wall 157 and is fastened thereto by suitable fasteners 159.

The outer corner posts 123 can each comprise two modified modules 81 as shown in FIG. 12. Each modified module 81A, 81B has a leg of its basic I-beam cut off. Thus on module 81A, one edge section and an adjacent web section is cut off at a saw groove from the central section 3A, other web section 7A and other edge section 5A of one member 1A in module 81A. Similarly, the other member 1B in module 81B is cut at a saw groove leaving the central section 3B, one web section 7B and one edge section 5B. The two modules are now positioned perpendicular to each other with the cut side 165 of member 1B in module 81B bearing against the flat side 9A of member 1A in module 81A near its outer side edge 37A. The cut side 167 of member 1A in module 81A faces, but is spaced from, the uncut member 1A in module 81B. A strip of rubber 168 provides a thermal barrier between cut side 167 and member 1A. A first closure plate 71F has its bead 73F inserted in groove 33B in member 1B of module 81A. The closure plate 71F overlaps the flat side 9A of member 1A in module 81B and is attached thereto with suitable fastening means 169. A second closure plate 71G has its bead 73G inserted in a groove 33A in the flat side 9A of member 1A abutting the cut side 165 of member 1B in module 81B. The plate overlies the flat side 9B of cut member 1B in module 81B and is fastened thereto by suitable fastening means 171. The two modules. 81A, 81B joined together, form corner post 123. A front glass panel 133 is mounted in the open end 85A of module 81A with sealing strips 143, 145, and a side glass panel 133 is mounted in the open end 85B of module 81B with sealing strips 143, 145.

Figure 13:
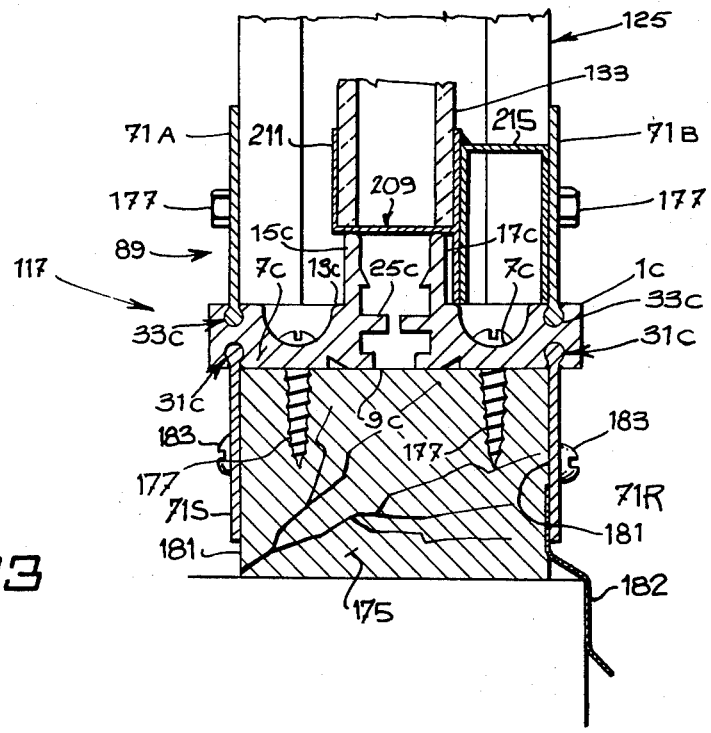
FIG. 13 is a cross-section view taken at location 13 in FIG. 7.

The bottom sill 117 as shown FIG. 13 comprises module 89 with the two connecting plates 71A, 71B mounted in grooves 33C. The module 89 is mounted on a wood beam 175 with the flat side 9C of member 1C against the beam. Fasteners 177 pass through the web sections 7C to connect the module 89 to the beam. Sections of the arms 15C, 17C are cut away down to side 13C so that posts 125 can be mounted flat against the side 13C between plates 71A, 71B. Fasteners 177 connect plates 71A, 71B to the posts 125 to join the still and posts together. The plates 71A, 71B can extend the length of the sill 117. Preferably however they are provided in short lengths as needed to fasten posts 125 to sill 117 as shown in FIG. 7. The glass panels 133 mounted between posts 125 are mounted on a sealing strip 209, resting on the legs 15C and 17C. The lower sealing strip 209 can have an upwardly extending flange 211 bearing against the inner surface of the panels 133. A metal strip 215 can be mounted in front of the panels 133 between the ribs 125 and the top of the plate 117. The sill 117 is mounted on the beam 175 with closure plates 71R and 71S, projecting down from groove 31C in the member 1C in module 89 to lie flush against the walls 181 of the beam 175 and to be fastened thereto with a fastener 183. A spout 182 is provided between the outer wall 181 of the beam 175, and the connecting plate 71R, in order to avoid rain water infiltration. The central web 25C in member 1C can be cut to provide a thermal break in the sill if desired.

Figure 14:
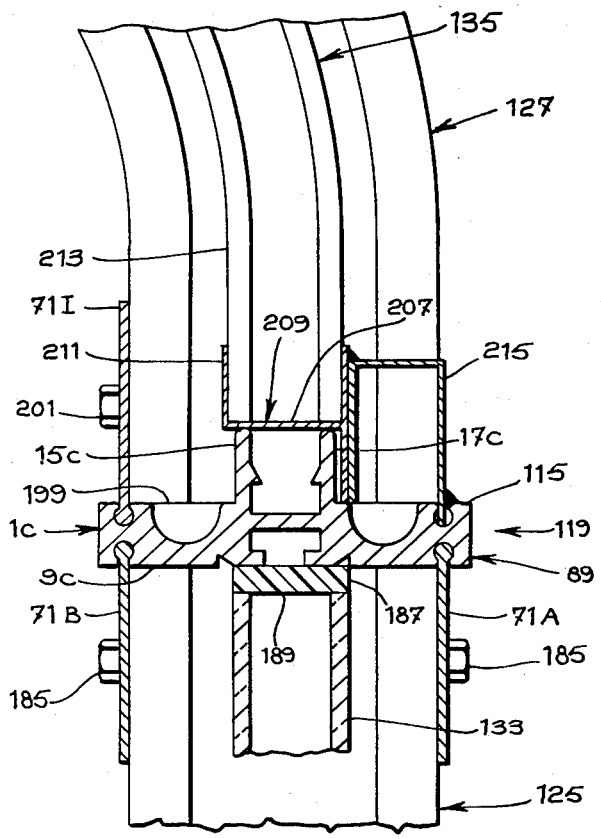
FIG. 14 is a cross-section view taken at location 14 in FIG. 7.

The top sill 119 of the front wall 109, as shown in FIG. 14, can also comprise a module 89 with the flat side 9C of member 1C facing down. The pair of closure plates 71A, 71B extend down from the member 1C and the posts 125 abut against the flat side 9C of the member 1C between the plates 71A, 71B. The plates are fastened to the posts 125 by suitable fasteners 185. A sealing strip 187 is mounted between the top edge 189 of the front glass panels 133 and the center of the flat side 9C of member 1C in module 89.

Figure 15:
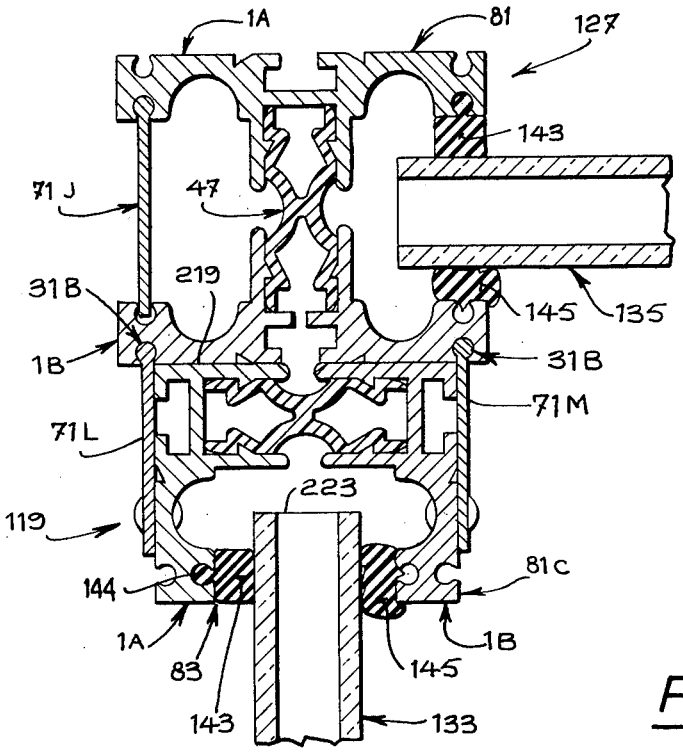
FIG. 15 is a cross-section view taken at location 15 in FIG. 7.
Figure 16:
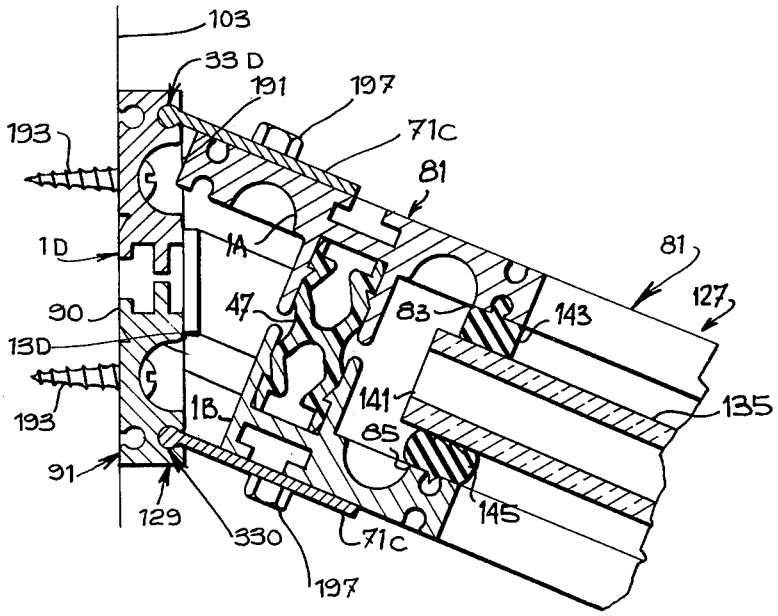
FIG. 16 is a cross-section view taken at location 16 in FIG. 7.

The roof rafters or ribs 127, as shown in FIG. 15 comprise modules 81 with one member 1A on top or the outside and the other member 1B on the bottom or inside. Their upper end 191 is angled as shown in FIG. 16 so that when the sloping ribs 127 are installed, their upper end 191 is parallel with the wall 103 of the building. The top plate 129 to which the ribs 127 are attached comprises a module 91. The member 1D in module 91 is attached with its flat side 90 flush against the wall 103 by suitable fasteners 193 passed through the web sections 7D. The pair of closure plates 71C project at an angle from the side 13D of member 1D, pivoting in the grooves 33D which are slightly wider than the plates 71C. The ribs 127 are mounted snugly between the plates 71C with their upper ends 191 abutting the side 13D of member 1D. Fasteners 197 connect the plates 71C to the ribs 127.

The ribs 127 have a lower portion 113 which is bent or curved to an extend to have the lower end 199 of the ribs 127 horizontal. This end 199 sits on the top sill 119 of the front wall 109 as shown in FIG. 14. More particularly, the ribs 127 abut on the side 13C of member 1C in module 89 forming the top sill 119. Where the ribs abut, the legs 15C, 17C of the member 1C are cut away. A connecting plate 71I mounted in the inside groove 33C of member 1C projects up and received the ends of the ribs 127 snugly thereagainst. The connecting plate 71J is fastened to the ribs by fasteners 201.

The glass roof panels 135 are mounted by suitable sealing strips between the ribs 127. At their upper end, they are mounted between a basic I-beam module 81, employing two structural members 1A, 1B and a connector 47. One member 1A of module 81 faces outwardly and the other member 1B, with a leg cut of, faces inwardly with connector 47 acting as a thermal barrier between members 1A and 1B. The glass roof panels 135 are mounted by their edges 141 in the open end 83 of the module 81 by sealings strips 143, 145.

The panels 135 follow the curvature of the ribs 127 and at their lower edge 207 are mounted on a sealing strip 209 resting on the legs 15C, 17C of the member 1C in module 89 between the ribs 127 as shown in FIG. 13.

The end ribs 127 can have their outer end 83 closed with a plate 71J as shown in FIG. 15, shaped to follow the curve in the ribs 127. The outer ribs 127 rest on the top plate 119 of the end walls 107. This top plate 119 comprises a modified module 81C having an edge section 3A, 3B and a web section 7A, 7B removed from the same side of both members 1A, 1B forming the module. The bottom member 1B in the rib 127 rests on the cut side 219 of the modified module 81C forming top plate 119. A pair of closure plates 71L, 71M project from the bottom grooves 31B in the bottom member 1B of module 81 to receive the modified module 81C therebetween. Fasteners 221 connect the plates 71L, 71M to the modified module 81C forming top plate 119. The top edges 223 of the glass panels 133 in the end walls 107 are mounted in the open end 83 of the modified module 81C by suitable sealing strips 143, 145.

Figure 17:
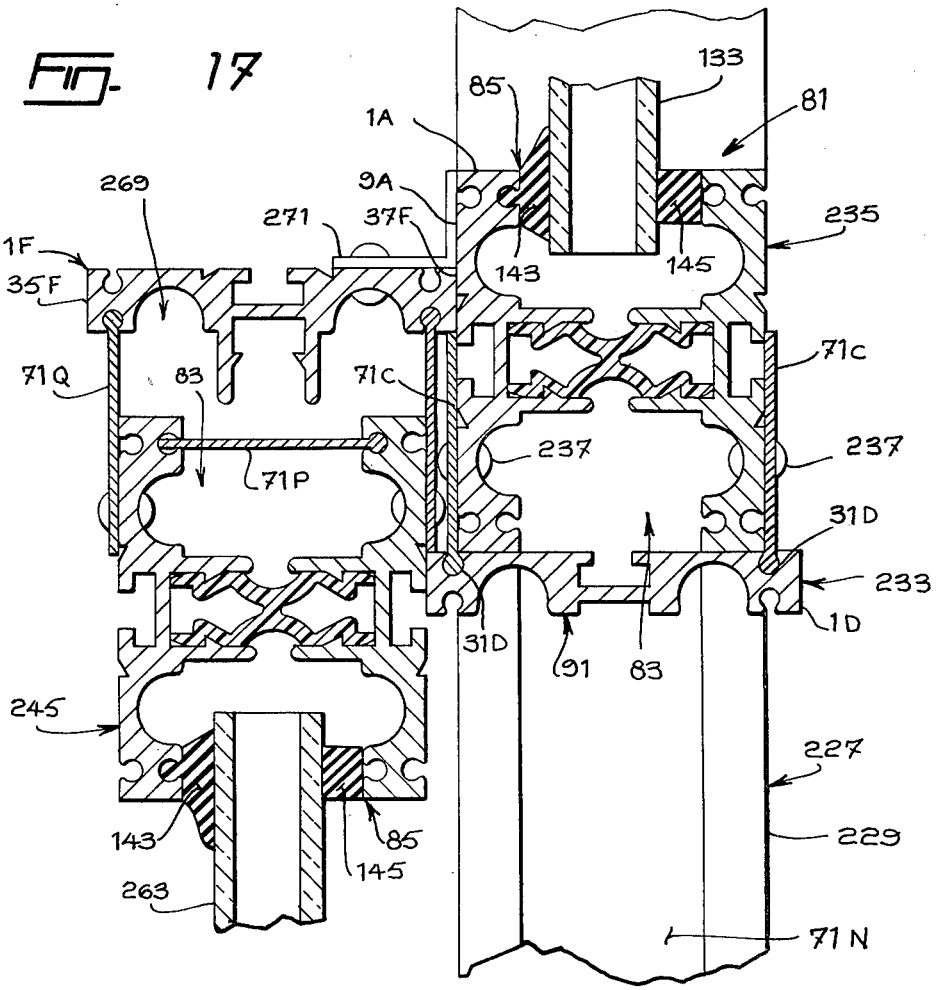
FIG. 17 is a cross-section view taken at location 17 in FIG. 7.
Figure 18:
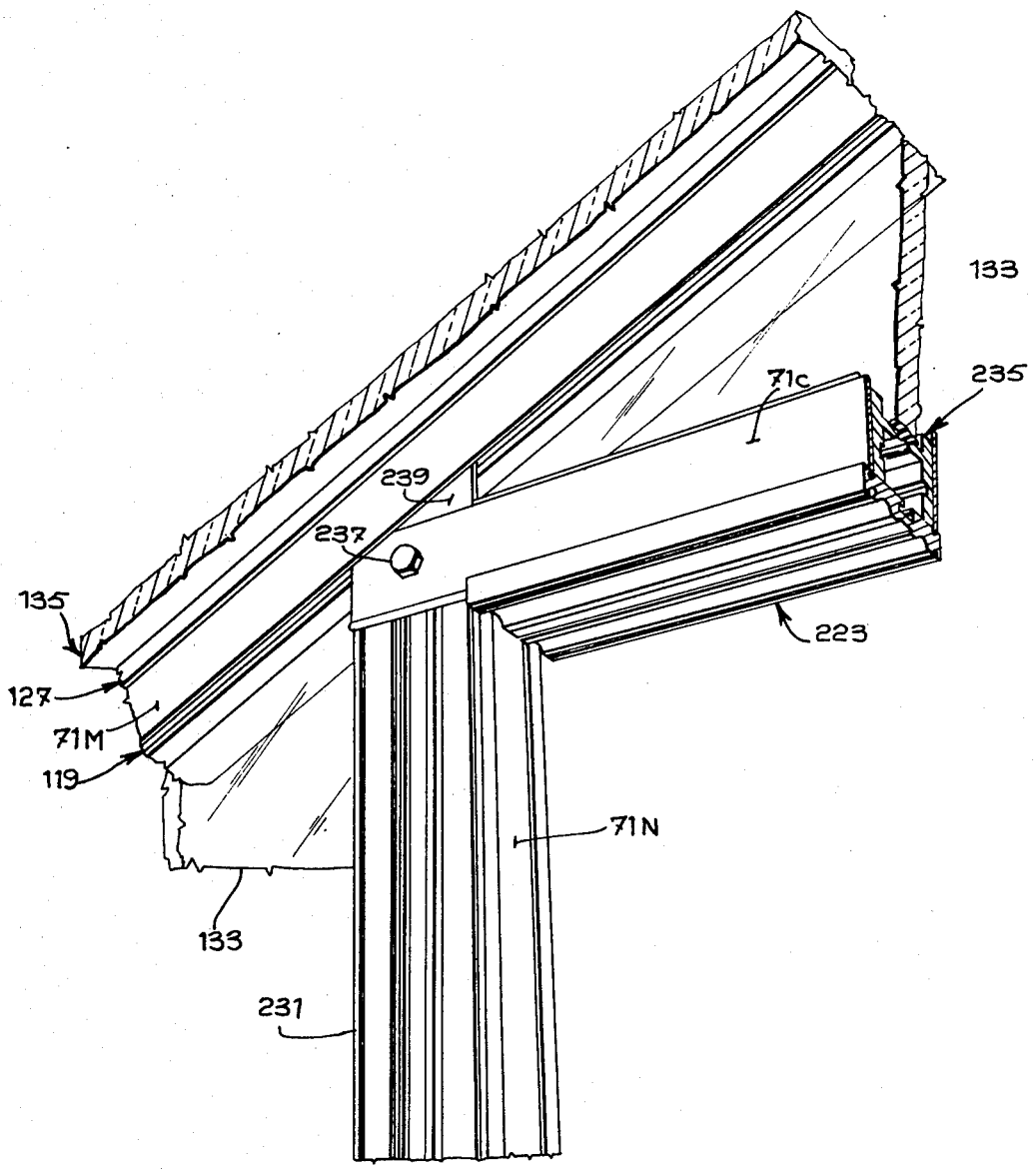
FIG. 18 is a perspective view taken from within the greenhouse looking at the top corner of the door frame, from the floor.

A door frame 227 in one end wall 107 can be defined by a pair or vertical side frame members 229, 231 each composed of a module 81, closed by a plate 71N on one side and open on the other side to receive the side edges of the glass panels 107. A top frame member 233 connects the side frame members 229, 231 and comprises a module 91. A cross frame member 235 extends across the end wall 107 from the outer door frame member 231 to the inner corner post 121. The cross frame member 235 comprises a module 81 with its bottom open end 83 closed by top frame member 233 as shown in FIG. 17 and 18. The pair of closure plates 71C in the module 91 forming the top frame member 233 extend up from the grooves 31D in member 1D. The cross frame member 235 is mounted between plates 71C. Fasteners 237 connect the closure plates 71C to the cross frame member 235. At the ends of top frame 233, the closure plates 71C can be extended to overlie the side frames 229, 231 as shown in FIG. 18. A fastener 237 ties plates 71C to the side frames 229, 231. A short connector plate 239 can tie the door frame to the top plate 119 as well. Glass panels 133 are mounted in the upper open end 85 of module 81 forming the cross-frame member 235 by suitable sealing means 143, 145.

Figure 19:
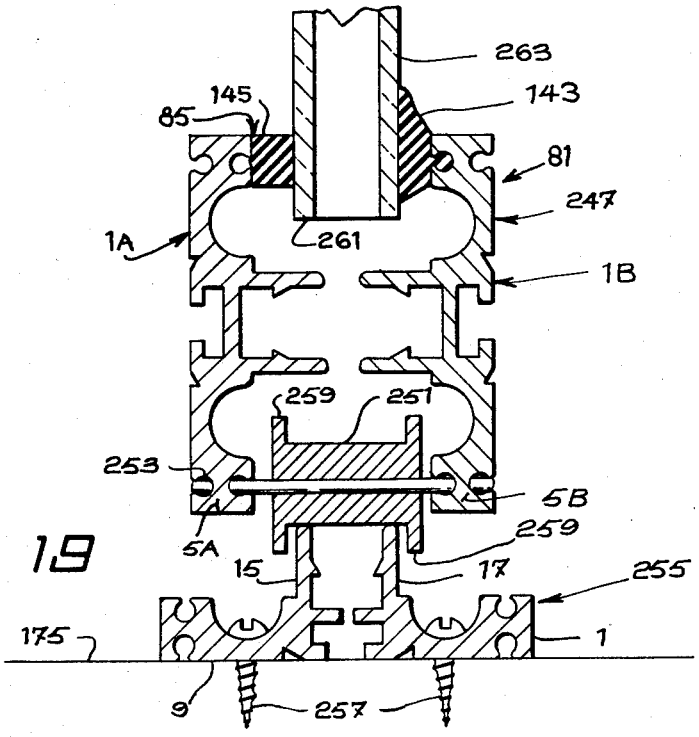
FIG. 19 is a cross-section view taken at location 19 of FIG. 7.

The door 137 can comprise side frames 241, 243 and top and bottom frames 245, 247 as shown in FIG. 8, with all the door frames made from modules 81. The bottom door frame 247 has rollers 251 mounted in its bottom open end 83 is shown in FIG. 19. The rollers 251 are mounted on axles 253 which extend between the bottom edge portions 5A, 5B of members 1A, 1B forming module 81. The rollers 251 run on a track 255 formed by the arms 15, 17 of member 1 fastened with its side 9 to the floor 175 by fasteners 257. The central web of member 1 can be cut to provide a thermal break if desired. The rollers 251 have flanges 259 for maintaining it on the track 255. The inner open ends 85 of the door modules 81 receive the edges 261 of a glass door panel 263 mounted therein with suitable sealing strips 143, 145 as shown in FIGS. 17 and 19. The outer open ends 83 of the modules 81 in the side and top frames 241, 243, 245, can be closed with a closure plate 71P, as shown in FIG. 17.

The upper part of the door can be guided in a slot 269 adjacent the cross frame member 235. The slot 269 is formed by attaching a member 1F to the cross frame 235 by an angle member 271. The member 1F is attached with one narrow side 37F flush against the wide side 9A of member 1A in module 81. A closure plate 71Q extends down from the outer narrow end 35F of member 1F. The top frame 245 of the door 137 is guided between closure plate 71P and the outer edge of the door frame member 233.

Figure 20:
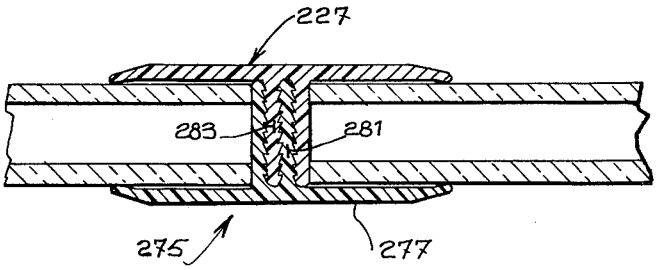
FIG. 20 is a cross-section view taken at location 20 in FIG. 7.

If desired, the glass panels 133, 135, can be made in smaller sections and joined together at their edges with novel connector strips 275. The connectors 275 can comprise an H-shaped structure formed from two identical T-shaped elements 277. Each T-shaped element 277 as shown in FIG. 20, has a stem formed from a pair of parallel legs 281, 283. The legs 281, 283 are spaced apart a distance equal to the width of one leg. One leg 281 of the element 277 is provided with rearwardly facing locking teeth on both sides of the leg. The other leg 283 is provided with rearwardly facing locking teeth on its one side facing the other leg. The connector 275 is formed by interlocking the legs of one element with the legs of a second identical element. The connector 275 receives the edges of adjacent glass panels in opposed slots. The elements 277 can be extruded from thermoplastic material.

While a greenhouse structure has been described to illustrate the use of the basic structural units, and the modules formed by the units, other open-framework types of buildings can be constructed as well.

The embodiments of the invention in which an exclusive property or privilege is claimed are defined as follows:

1. A structural building unit comprising a bar-shaped member having two wide sides, a central section, two narrow sides and two edge sections formed adjacent said narrow sides, respectively, first connecting means comprising a pair of spaced-apart arms projecting transversely from one of said wide sides of the member and forming a slot therebetween, and second connecting means in each edge section, each of said second connecting means comprising first and second grooves, said grooves being identical in shape and aligned in one edge section close to the adjacent narrow side, said first groove extending into said one edge section from said one wide side toward said second groove, and said second groove, being opposite the first groove, and extending into said one edge section from the other wide side of the member toward said first groove.

2. A unit as claimed in claim 1 wherein the arms have inner side surfaces and have locking tabs projecting inwardly from said inner side surfaces.

3. A unit as claimed in claim 2 wherein the first and second grooves have bottoms, and said bottoms of the first and second grooves are rounded and enlarged.

4. A unit as claimed in claim 3 including web sections joining the edge sections to the central section.

5. A unit as claimed in claim 3 wherein the central section includes a thin central web portion.

6. A unit as claimed in claim 3 including guide grooves on the other wide side of the member defining each side of the central section.

7. A structural building module comprising two bar-shaped members with each member having two wide sides, a central section, two narrow sides, and two edge sections formed adjacent said narrow sides, respectively, first connecting means comprising a pair of spaced-apart arms projecting transversely from one of said wide sides of the member and forming a slot therebetween, and second connecting means in each edge section, each of said second connecting means comprising first and second grooves, said grooves being identical in shape and aligned in one edge section close to the adjacent narrow side, said first groove extending into said one edge section from said one wide side toward said second groove, and said second groove, being opposite the first groove, and extending into said one edge section from the other wide side of the member toward said first groove; and a connecting element extending into the slots of the first connecting means of the members and joining the two members together with their one wide sides facing and parallel to each other.

8. A module as claimed in claim 7 wherein the distance between the inner edges of the first grooves in either member is substantially equal to the distance between the other wide sides of the two members.

9. A module as claimed in claim 7 wherein the first connecting means and the connecting element have cooperating means for connecting the members together a predetermined distance apart.

10. A module as claimed in claim 7 including rollers mounted between the two members, the rollers being mounted between opposite edge sections in the two members.

11. A module as claimed in claim 7 including at least one plate element projecting from either wide side of at least one of members, the plate element being connected to the one member via the second connecting means.

12. A module as claimed in claim 7 including at least one plate element projecting from the other wide side of at least one of the members, the plate element being connected along one edge to the one member via the second connecting means, and fastening means for connecting the plate element to another part of a building structure.

13. A module as claimed in claim 7 including two plate elements projecting from the other wide side of at least one of the members, the two plate elements each being connected along one edge to the one member via the second connecting means, and fastening means for connecting the plate elements to a second module inserted between the plates to abut the one member on its other wide side.

14. A module as claimed in claim 7 wherein each groove has a bottom and the bottom of each groove is enlarged and rounded.

15. A module as claimed in claim 14 including at least one plate element projecting from either wide side of at least one of the members, the plate element having a circular bead, the plate element being connected to the one member by sliding it into the groove with its bead in the bottom of the groove, the plate element having a width nearly equal to the distance between the bottom of a first groove in one member in the module, and the bottom of a first groove in the other member facing the said first groove in the one member.

* * * * *